United States Patent [19]

Frantz et al.

[11] Patent Number: 4,876,416

[45] Date of Patent: Oct. 24, 1989

[54] MULTIPLE POSITION ROTARY SWITCH

[75] Inventors: Leo R. Frantz, Lakewood; Alfred Bauer, Parma; Matthew H. Koran, Olmsted Township, Cuyahoga County; Jack Becker, South Euclid, all of Ohio

[73] Assignee: Actron Manufacturing Company, Cleveland, Ohio

[21] Appl. No.: 306,536

[22] Filed: Feb. 3, 1989

[51] Int. Cl.[4] ..... H01H 19/58

[52] U.S. Cl. ..... 200/11 R; 200/11 DA; 200/11 G; 200/565

[58] Field of Search ..... 200/11 R, 11 D, 11 DA, 200/11 G, 11 J, 11 K, 11 TW, 292, 303, 565

[56] References Cited

U.S. PATENT DOCUMENTS

| | | | |
|---|---|---|---|
| 3,437,766 | 4/1969 | Ahrens | 200/11 K |
| 3,525,824 | 8/1970 | Von Fange | 200/11 D |
| 3,734,869 | 5/1973 | Menard et al. | 200/11 R |
| 3,903,383 | 9/1975 | Marker | 200/11 TW |
| 4,131,771 | 12/1978 | Erickson et al. | 200/11 DA |
| 4,232,207 | 11/1980 | Kuhl et al. | 200/11 R |
| 4,310,734 | 1/1982 | Yamashita et al. | 200/11 R |
| 4,392,030 | 7/1983 | Buss | 200/11 R |
| 4,490,588 | 12/1984 | Guenther et al. | 200/11 R |
| 4,551,587 | 11/1985 | Rose | 200/11 R |
| 4,625,084 | 11/1986 | Fowler et al. | 200/11 DA |

*Primary Examiner*—J. R. Scott

*Attorney, Agent, or Firm*—Calfee, Halter & Griswold

[57] ABSTRACT

A multiple position rotary switch is disclosed for incorporation into an electrical device. The switch comprises an annular cup that serves as a housing for the switch and which receives a knob for rotation therein. The knob is retained within the cup by a circuit board that is removably secured to the cup. The circuit board includes a first major surface having a switching circuit formed thereon and a second major surface. The circuit board is removably secured to the cup by a plurality of barbed ears which extend from the sidewall of the cup such that the first surface of the board is located between the knob and the second surface of the board. The cup includes an upstanding sidewall and a race against which the knob rotates. The race includes a plurality of protrusions which facilitate the retention of the knob in preselected positions as the knob is rotated. The knob comprises a cylindrical disk having on one surface a handle. Along its opposite surface the knob includes a plurality of wipers that rotate with the knob and contact the switching circuit formed on the first surface of the circuit board. The wipers selectively close the switching circuit when the knob is rotated to preselected positions. The second surface of the circuit board includes a plurality of plated-through openings which are electrically connected to the switching circuit. The openings each include an upstanding pin that facilitates the connection of the switch to an electrical device.

21 Claims, 7 Drawing Sheets

MULTIPLE POSITION ROTARY SWITCH

DISCLOSURE OF THE INVENTION

This invention relates to a switch for use in connection with an electrical device. More particularly, the invention relates to a multiple position rotary switch that may easily be incorporated into any one of a variety of electrical devices.

BACKGROUND

The prior art provides various types of multiple position rotary switches for use in connection with electrical devices.

One example of a prior art multiple position rotary switch may be found in Erickson, et al., U.S. Pat. No. 4,131,771. The Erickson, et al. switch comprises a wheel attached to the end of a shaft. The wheel is mounted within a housing between a pair of circuit boards. A spring loaded detent engages serrations provided along the outer diameter of the wheel in order to retain the wheel in preselected positions. The top and bottom of the wheel each include a plurality of brushes that contact the circuits formed on the circuit boards as the shaft rotates the wheel. The circuit boards are permanently held in position by meltable pins. More particularly, after the circuit boards are properly aligned with the wheel sandwiched therebetween, the pins are melted in order to permanently secure the boards in position. Thus, as a result of this permanent form of mounting, the replacement or substitution of the circuit boards with other circuit boards having alternate circuit configurations is not readily possible.

Another example of a prior art switch may be found in the Model 77 Multimeter produced by John Fluke Mfg., Co., Inc. of Everett, Washington. The switch utilized in this device comprises a circular non-conductive stationary disk having mounted on each of its major surfaces a plurality of posts. A smaller rotatable disk is provided in the center of the stationary disk. Each side of the rotatable disk includes a pair of contacts which serve to complete connections between the posts located on each side of the stationary disk as the rotational disk is rotated. The posts are electrically connected to the main circuit board of the device and are permanently held in position upon the stationary disk by rivets.

The prior art further provides an electrical device distributed by the assignee of the present invention. The electrical device includes a switch mechanism having a race that is integrally formed into the top cover of the electrical device. The top cover includes an opening through which a portion of the knob of the switch mechanism extends. The race extends around the entire diameter of the opening along the inside surface of the top cover. The knob is retained within the opening by a circuit board that is mounted to the top cover such that a portion of the knob is sandwiched between the circuit board and the race. The circuit board includes both the circuits which serve to electrically interconnect the electrical components mounted upon the board and the switching circuit which provides the switching functions for the device. The race includes a plurality of spaced arcuate protrusions that form multiple peaks and valleys along the race. The knob comprises a cylindrical disk having on one surface a handle and at the opposite surface a protruding rim. The rim includes a first and second pair of diametrically opposed upstanding platforms. The first platforms are of sufficient size that rotation of the knob, the first pair of platforms glide along the peaks of the protrusions. The second platforms each include a socket for receiving a spring and a ball bearing. The bearing is located on top of the spring such that the ball bearing is sandwiched between the spring and the race. The spring provides a biasing force which retains the bearing against the rate such that as the knob is rotated, the bearing aligns itself in the valleys of the race thereby mechanically stabilizing the knob in preselected positions. Between the preselected positions, the bearing is received within the socket so as to allow the bearing to slide over the top or peaks of the protrusions. The knob includes along its opposite end a plurality of wiping members that rotate with the knob and contact the switching circuit thereby selectively closing the switching circuit as the knob is rotated to preselected positions. In this electrical device, the wave soldering of the electrical components upon the circuit board is not feasible because of the possibility of the switching circuit being damaged during the wave soldering process.

SUMMARY OF THE INVENTION

The present invention provides a new construction for a multiple position rotary switch that provides several distinct advantages over prior art switches. More particularly, the present invention provides a rotary switch that may be easily mounted and electrically connected to a separate electrical device such as, for example, the primary or mother circuit board of a multimeter, radio or automotive test device.

The present invention further provides a rotary switch wherein the switching circuit board, which forms an integral part of the switch, is capable of being readily removed and replaced with another switching circuit board prior to installation of the switch within an electrical device. Such easy and quick replacement of the switching circuit board allows the switch to provide alternate switching functions, thereby facilitating the use of the switch in connection with various types of electrical devices. Also, it is determined subsequent to the production of the switch, and prior to its installation into an electrical device, that the switching circuit board is defective, the switching circuit board may be easily replaced thereby salvaging the remaining components of the switch.

The present invention provides a switch that facilitates the construction of an electrical device wherein the majority or all of the electrical components (i.e., for example, resistors, capacitors, relays and the like) are wave soldered onto one or more primary or mother circuit boards without risking damage to the switching circuit of the switch. More particularly, since the switch constitutes a separate assembly having its own switching circuit board, the mother circuit board of an electrical device may be produced without a switching circuit. Thus, the electrical components of such mother board may be connected to the mother board using wave soldering techniques without risking any damage to the separate switching circuit board of the switch. The ability to utilize wave soldering techniques in the production of the mother circuit boards for an electrical device results in considerable labor cost savings as compared to the utilization of hand soldering techniques.

In a preferred embodiment a multiple position rotary switch made in accordance with the present invention comprises an annular cup that serves as a housing for the switch and receives a knob for rotation therein. The knob is retained within the cup by a switching circuit board. The switching circuit board includes a first major surface having a switching circuit formed thereon and a second major surface located opposite the first major surface. Upon attachment of the switching circuit board to the cup, the first surface of the circuit board is sandwiched between the knob and the second surface of the circuit board.

The switching circuit board is removably attached to the cup by a plurality of barbed ears that extend from the cylindrical sidewall of the cup. The barbed ears deflect outwardly as the switching circuit board is inserted within the confines of the sidewall. Once the switching circuit board is received beneath the barbs of the barbed ears, the barbed ears return to their normal or unbiased position securely attaching the board to the cup. Removal of the switching circuit board is easily facilitated by deflecting the barbed ears outwardly and lifting the board from the cup. Such easy installation and removal of the switching circuit board allows the switch to utilize various types of switching circuit boards thereby allowing the switch to provide numerous types of switching functions. With the ability to provide different switching functions, the switch may readily be incorporated into various types of electrical devices, each of which have their own specific switching requirements. The easy installation and removal of the switching circuit board also allows a defective switching circuit board to be replaced prior to the installation of the switch into an electrical device.

Extending inwardly from the sidewall of the cup is a shoulder having a race against which a portion of the knob rotates. The race includes a plurality of spaced arcuate protrusions that form multiple peaks and valleys along the race. The knob comprises a cylindrical disk having at one end a handle and at its opposite end a protruding rim. The rim includes a first and a second pair of diametrically opposed upstanding platforms. The first platforms are of sufficient size that upon rotation of the knob the first platforms glide along the peaks or tops of the protrusions. The second platforms each include a socket for receiving a spring and a ball bearing. The bearing is located on top of the spring such that the ball bearing is sandwiched between the spring and the race. The spring provides a biasing force that retains the bearing against the race. As the knob is rotated, the bearing aligns itself in the valleys of the race thereby mechanically stabilizing the knob in preselected positions. As the knob is rotated between the preselected positions, the bearing is received within the socket so as to allow the bearing to slide over the peaks of the protrusions.

The knob also includes along its opposite end a plurality of wipers or wiping members. The wiping members rotate with the knob and contact the switching circuit formed on the first surface of the switching circuit board. As the knob is rotated to preselected positions, the wiping members selectively close the switching circuit thereby allowing the switch to provide various switching functions.

The switching circuit board further includes numerous plated-through openings located along the outer diameter of the switching circuit board which extend from the second surface thereof. These plated-through openings are electrically connected to the switching circuit formed on the first surface of the switching circuit board. Mounted within the plated-through openings are a plurality of upstanding pins. These pins facilitate the easy and quick connection of the switch to another electrical device such as the mother board of a multimeter. More particularly, the switching circuit board is easily attached to a mother board by inserting the distal ends of the pins of the switching circuit board into openings formed in the mother circuit board such that the switching circuit board is spaced from the mother circuit board. Simultaneously therewith, a plurality of outwardly extending barbed ears which extend from the sidewall of the cup are received within slots formed in the mother circuit board until the barbed ears engage the mother circuit board thereby securely stabilizing the switch upon the mother circuit board. The pins of the switching circuit board and the electrical components for attachment to the mother circuit board are then simultaneously wave soldered to the mother circuit board. Since there is no reason to include a switching circuit on the mother circuit board that is utilized in conjunction with the switch, and since the switching circuit board of the switch is spaced from the mother circuit board by the pins upon attachment of the switch to the mother circuit board, the wave soldering of the mother circuit board and the simultaneous electrical connecting of the switch and the electrical components to the mother board is possible without any risk of damage to the switching circuit of the electrical device (i.e., the switching circuit of the switching circuit board).

The foregoing and other features of the invention are hereinafter more fully described and particularly pointed out in the claims. The following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
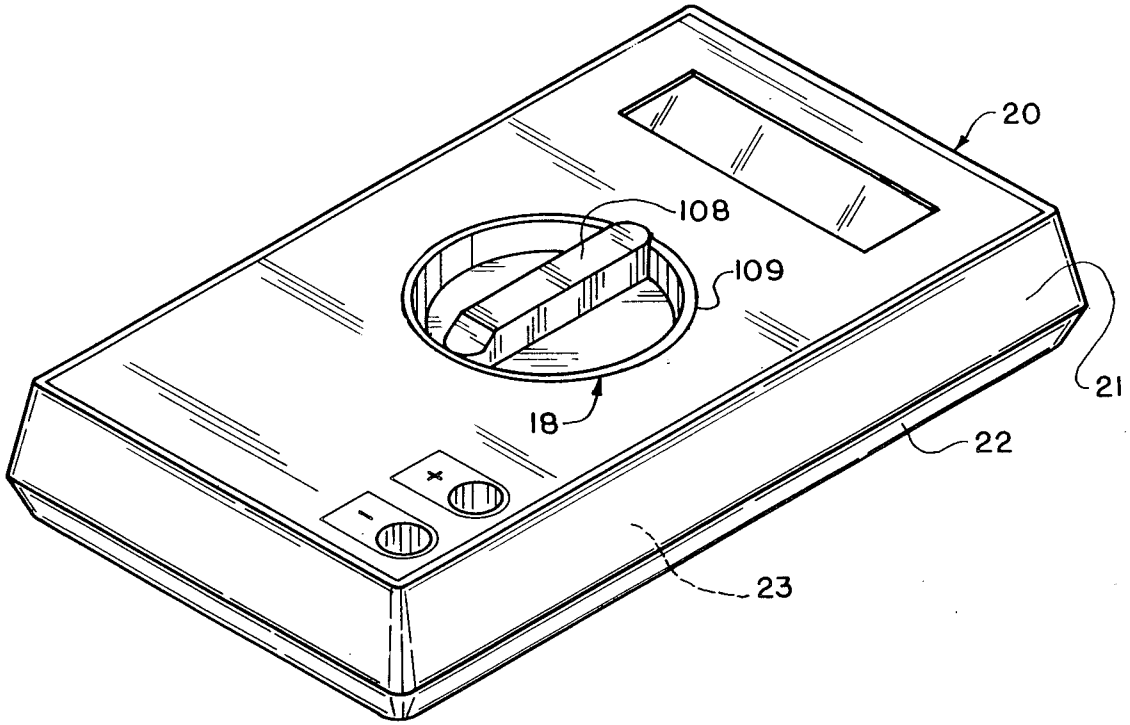
FIG. 1 is a perspective view of a multiple position rotary switch made in accordance with the present invention mounted within a schematically illustrated electrical device.
Figure 2:
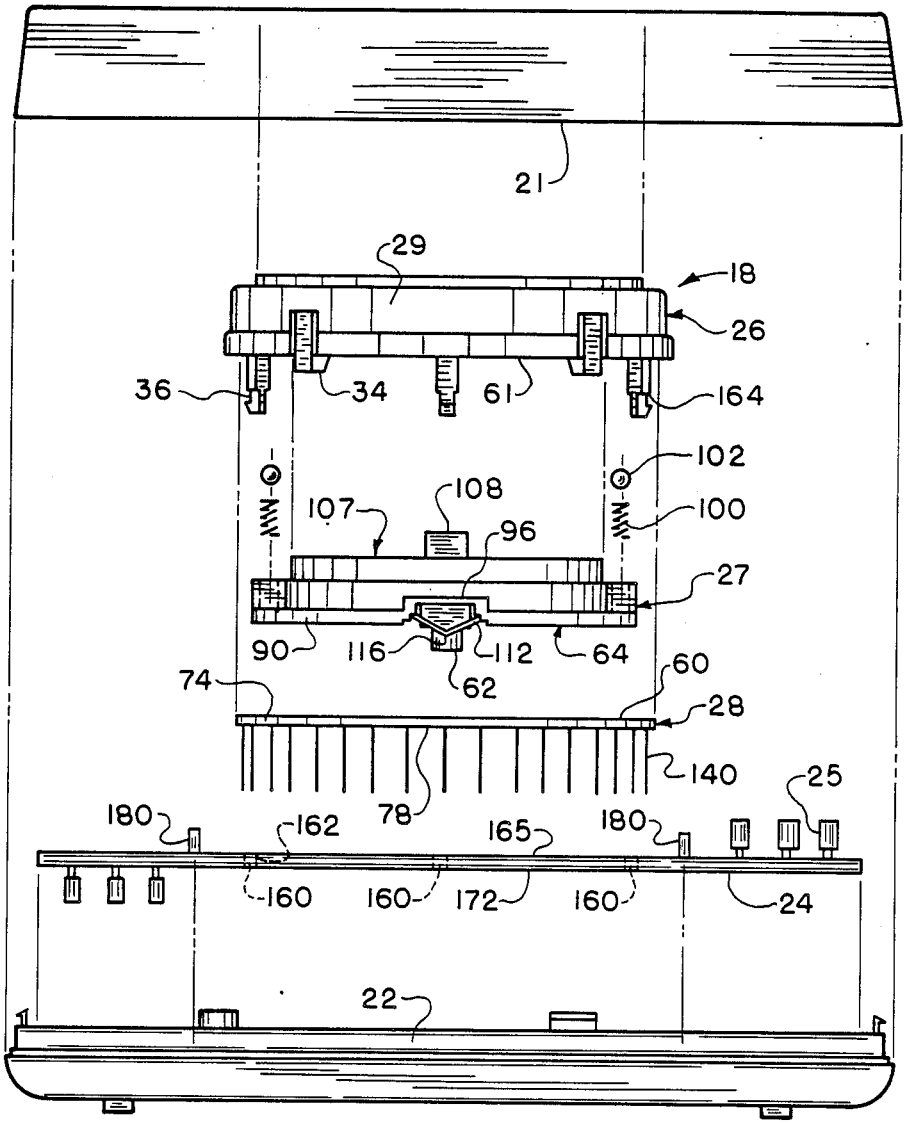
FIG. 2 is an exploded view of the rotary switch and the electrical device shown in FIG. 1.
Figure 2A:
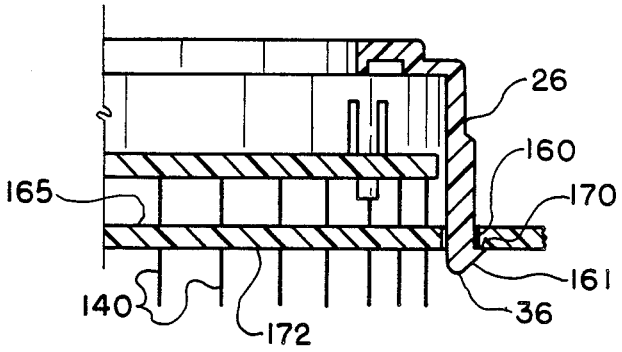
FIG. 2A is a fragmentary cross section of the rotary switch and mother circuit board shown in FIG. 2 with the rotary switch attached to the mother circuit board.
Figure 3:
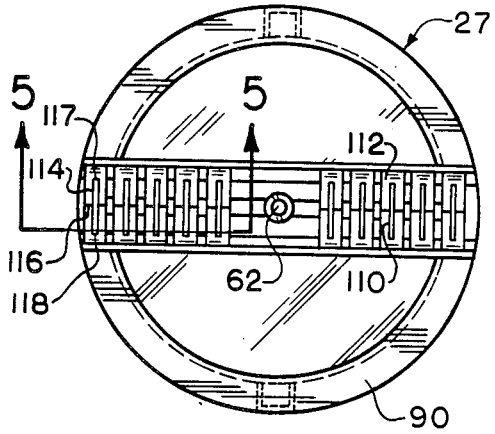
FIG. 3 is a bottom plan view of the knob of the rotary switch shown in FIG. 1.
Figure 4:
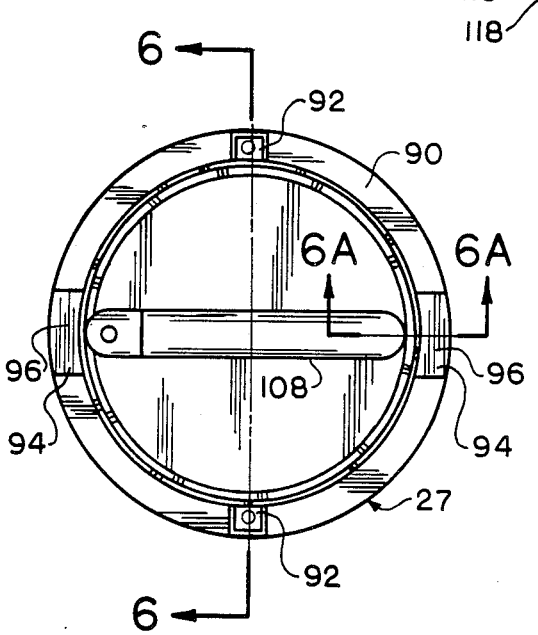
FIG. 4 is a top plan view of the knob shown in FIG. 3.
Figure 5:
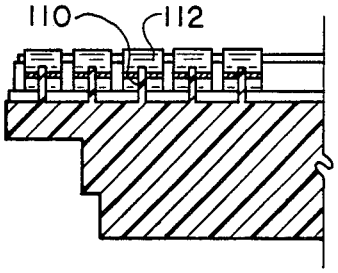
FIG. 5 is a partial cross section of the knob shown in FIG. 3 taken along line 5—5 thereof.
Figure 6:
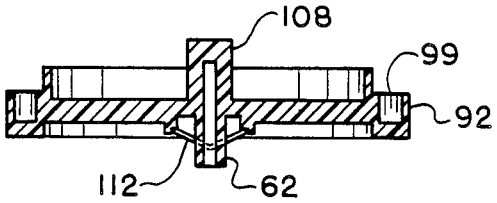
FIG. 6 is a cross section of the knob shown in FIG. 4 taken along line 6—6 thereof.
Figure 6A:
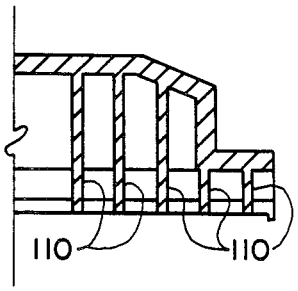
FIG. 6A is an enlarged fragmentary cross section of the knob shown in FIG. 4 taken along line 6A—6A thereof.
Figure 7:
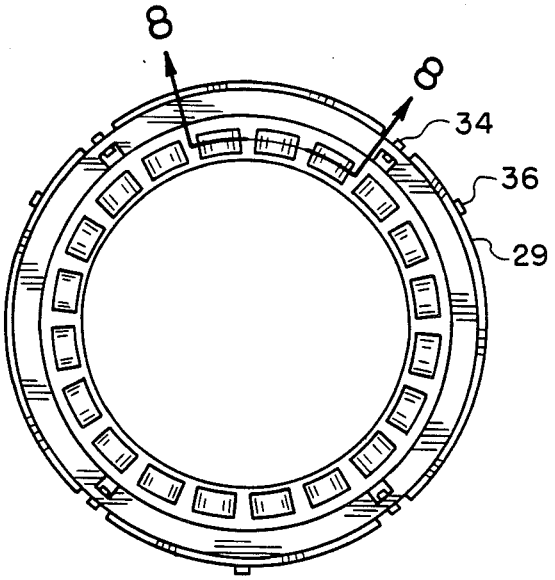
FIG. 7 is a top plan view of the cup of the rotary switch shown in FIG. 1.
Figure 8:
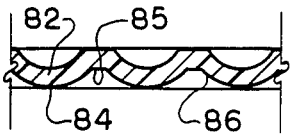
FIG. 8 is an enlarged fragmentary cross section of the cup shown in FIG. 7 taken along line 8—8 thereof.
Figure 9:
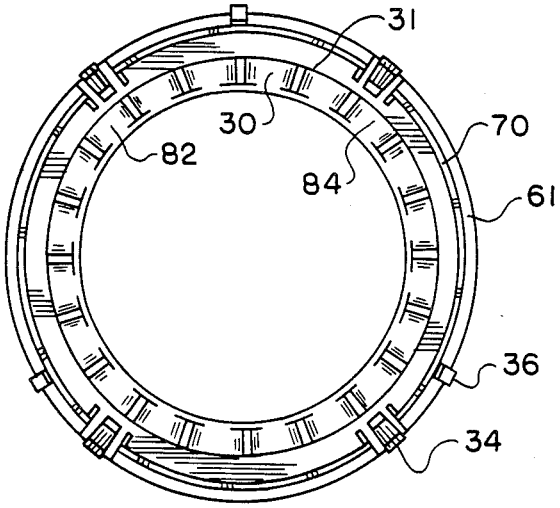
FIG. 9 is a bottom plan view of the cup shown in FIG. 7.
Figure 10:
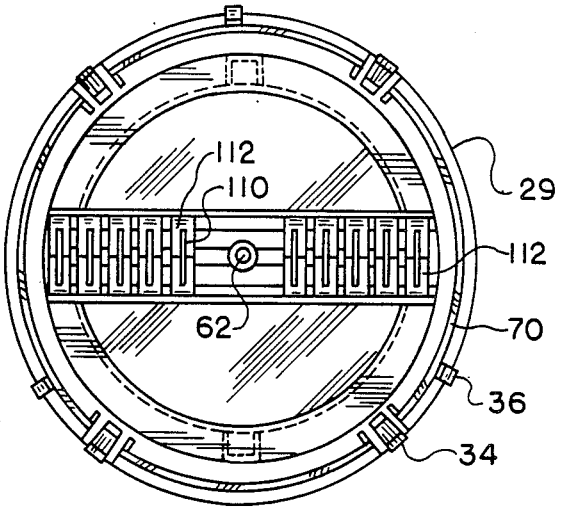
FIG. 10 is a bottom plan view of the rotary switch shown in FIG. 1 with the knob inserted in the cup and the switching circuit board removed.

Referring to the drawings, and initially to FIGS. 1 and 2, there is illustrated a multiple position rotary switch 18 made in accordance with the present invention which may be used in an electrical device 20 (schematically illustrated). Electrical device 20 may comprise any one of a variety of devices including, for example, a multimeter, a radio or an automotive tester.

Electrical device 20 includes a cover 21 and a base 22 which cooperate to form an enclosure 23 therebetween. Contained within the enclosure 23 is a primary or mother circuit board 24 having mounted thereto a plurality of electrical components 25 (schematically illustrated) such as, for example, resistors, capacitors, relays and the like. Preferably, electrical components 25 and the switch 18 are simultaneously electrically connected to the mother circuit board 24 utilizing wave soldering techniques. Since switch 18 performs the switching function for electrical device 20, mother circuit board 24 does not include a switching circuit. Thus, it is possible to wave solder electrical components 25 onto mother circuit board 24 without risking any damage to the switching circuit of the electrical device 20. The utilization of wave soldering techniques in the production of mother circuit board 24 results in considerable labor cost savings as compared to producing mother circuit board 24 utilizing hand soldering techniques.

Referring now additionally to FIGS. 2A and 7–12, switch 18 includes an annular cup 26 that serves as a housing for the switch 18, and a rotatable knob 27 that is partially received within the confines of the cup 26. Knob 27 is retained within the cup 26 by switching circuit board 28. Annular cup 26 includes a cylindrical sidewall 29 having a race 30 formed along the inside diameter of an inwardly extending shoulder 31. Extending from the sidewall 29 of the cup 26 are a plurality of inwardly protruding flexible barbed ears 34 and longer outwardly protruding flexible barbed ears 36. Outwardly protruding barbed ears 36 facilitate the attachment of the cup 26, and thus the attachment of the entire switch 18, to mother circuit board 24 as discussed in greater detail below. Inwardly protruding barbed ears 34 facilitate the attachment of the switching circuit board 28 to the cup 26 as discussed in further detail below.

Upon installation of switching circuit board 28 onto cup 26, knob 27 is retained within cup 26. More particularly, upon insertion of the switching circuit board 28 into the confines of the cup 26, the knob 27 is sandwiched between the top or first major surface 60 of the switching circuit board 28 and the race 30. Switching circuit board 28 is detachably secured to cup 26 by the inwardly protruding barbed ears 34. Specifically, after insertion of the knob 27 within cup 26, switching circuit board 28 is attached to cup 26 by inserting switching circuit board 28 into the expanded diameter portion 61 of sidewall 29 until the first surface 60 of the switching circuit board 28 contacts the ledge 70 which extends along almost the entire diameter of sidewall 29. Simultaneously therewith, the stem 62 included along the underside surface 64 of the knob 27 must be properly aligned with the central opening 66 provided in the switching circuit board 28 so as to allow the stem 62 to extend therethrough. As switching circuit board 28 is being inserted,, flexible barbed ears 34 deflect outwardly as the protruding barbs 72 of the barbed ears 34 cam over the outer edge 74 of the switching circuit board 28. Once the switching circuit board 28 is properly seated against the ledge 70, the barbed ears 34 return to their unbiased or undeflected position and the horizontally extending surface 77 of the protruding barbs 72 engage the second major surface 78 of the switching circuit board 28 securely retaining the switching circuit board 28 to the cup 26. Switching circuit board 28 is easily removed from cup 26 deflecting barbed ears 34 outwardly and separating switching circuit board 28 from the cup 26.

Figure 11:
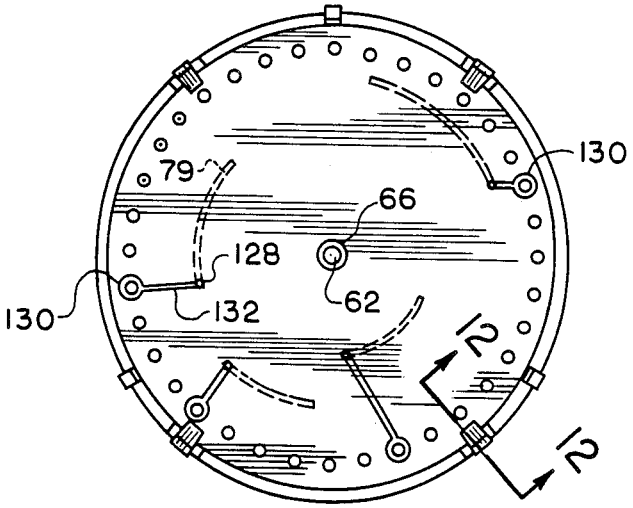
FIG. 11 is a bottom plan view of the rotary switch shown in FIG. 1 with the switching circuit board installed within the cup.
Figure 12:
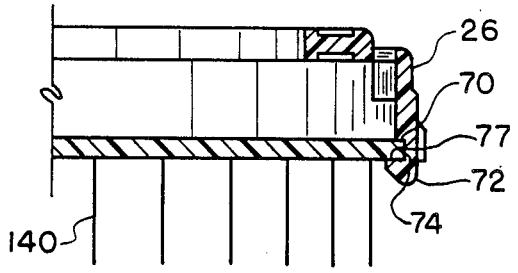
FIG. 12 is a cross section of the rotary switch shown in FIG. 11 taken along line 12—12 thereof.

As partially shown with hidden lines in FIG. 11, the first major surface 60 of the switching circuit board 28 includes a switching circuit 79 formed thereon. Switching circuit 79 may have any one of a variety of configurations depending upon the particular switching function requirements of the electrical device which switch 18 is used in connection with.

The easy removal and installation of switching circuit boards as provided by switch 18 affords a great deal of flexibility for it allows switch 18 to be utilized with any one of a variety of switching circuit boards, each of which have different switching circuits. The ability to utilize switch 18 with switching circuit boards having different switching circuits allows switch 18 to provide various switching functions. Since switch 18 is capable of providing different types of switching functions, switching 18 is capable of being used with a variety of electrical devices, each of which have their own specific switching requirements. Thus, switch 18 may be utilized with various types of electrical devices by merely changing the switching circuit board 28.

The race 30 of cup 26 includes a plurality of arcuate protrusions 82 that form a multitude of peaks 84 and valleys 85 along the inside surface 86 of the race 30. Knob 27 includes a protruding rim 90 having a first pair of diametrically opposed platforms 92 and a second pair of diametrically opposed platforms 94 which contact the inside surface of race 30. The second platforms 94 include at their distal ends a flat surface 96 of sufficient width to ensure that as the knob 27 is rotated within cup 26, the knob 27 does not catch or engage the peaks 84 or valleys 85 formed by the protrusions 82 of the race 30. The first platforms 92 each include a socket 99 for retaining a spring 100 and a ball bearing 102.

Figure 13:
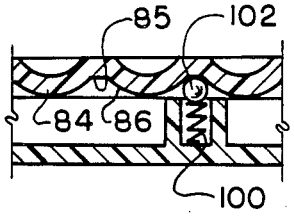
FIG. 13 is fragmentary enlarged cross section of the rotary switch of FIG. 1 illustrating a portion of the knob and housing with the ball bearing located in one of the valleys formed by the protrusions of the race.
Figure 14:
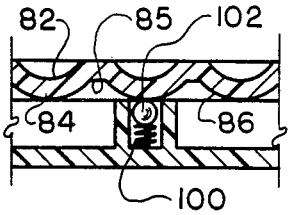
FIG. 14 is a fragmentary enlarged cross section of the rotary switch of FIG. 1 illustrating a portion of the knob and housing with the ball bearing located upon the peak of one of the protrusions of the race.

As shown in FIG. 13, the spring 100 serves to bias the bearing 102 against the inside surface 86 of the race 30, such that when the platform 92 is aligned with valleys 85 of the race 30, the ball bearing 102 is pushed into and captured in such valleys 85 thereby retaining the knob 27 in preselected positions. As shown in FIG. 14, when the knob 27 is rotated between preselected positions, the spring 100 is compressed within the socket 99 thereby allowing the ball bearing 102 to pass over the peaks 84 of the protrusions 82. Preferably, a non-conductive grease is provided along race 30 in order to ensure the smooth rotation of knob 27.

Although in the preferred embodiment, switch 18 does not include any stops or means for limiting the rotation of the knob 27, it will be appreciated that a switch made in accordance with the present invention may include a stop or other means to limit the positions through which the knob can be rotated. Also, it will be appreciated that in addition to incorporating such stops directly into the switch, such stops may be incorporated into the cover, base or mother circuit board which the switch is used in connection with.

Referring now additionally to FIG. 3–6A, the top surface 107 of knob 27 includes a handle 108 which permits a user to grasp the knob 27 and rotate it to preselected positions. When switch 18 is installed in electrical device 20, handle 108 extends through the top of opening 109 formed in cover 21. The underside surface 64 of the knob 27 includes a plurality of shelves or ribs 110 upon which multiple wipers or wiping members 112 are mounted. Wipers 112 comprise flexible V-shape pieces of metal having a slot 114 formed lengthwise through the center thereof. The wipers are installed upon ribs 110 by first aligning the slot 114 of a wiper with one of the ribs 110. A force is then applied to the apex 116 of the wiper 112 which causes the slit 114 and wiper 112 to lengthen until the ends 117 of the slot 114 slide over the edges 118 of the rib 110. Upon releasing the force applied to the apex 116 of the wiper 112, the ends of the slot 114 engage the edges 118 of the rib 110 thereby retaining the wiper 112 upon the rib 110. The wipers 112 serve to selectively close the switching circuit 79 formed on the first surface 60 of the circuit board 28 as the knob 27 is rotated to preselected positions.

Preferably, as illustrated in the drawings, knob 27 includes a plurality of ribs 110 so as to allow different numbers of wipers 112 to be mounted upon knob 27 at various locations. Varying the number and location of the wipers 112 upon knob 27 allows switch 18 to provide different switching functions utilizing the same switching circuit board. Also, depending on the particular type of switching circuit board utilized with switch 18, a specific number and location of wipers 112 upon knob 27 may be needed in order for switch 20 to provide the specific switching functions required by a particular electrical device.

Figure 15:
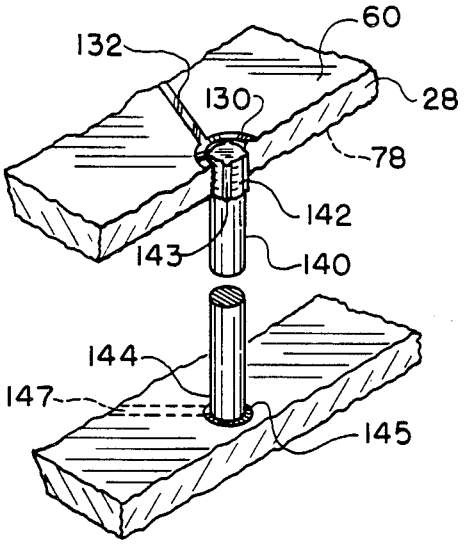
FIG. 15 is a fragmentary, partially broken-away enlarged perspective view of the switching circuit board and mother circuit board shown in FIG. 2 with the switching circuit board connected to the mother circuit board.

Referring now additionally to FIG. 15, the second major surface 78 of the switching circuit board 28 includes a plurality of plated-through openings 128 that extend from the switching circuit 79 formed on the first surface 60 through to the second surface 78. Provided along the circumference or outer diameter of the switching circuit board 28 are a plurality of plated openings 130. Preferably, as shown in FIG. 15, openings 130 are plated-through openings that extend from the second surface 78 through to the first surface 60. Electrically connecting the openings 128 to the openings 130 are a plurality of leads or traces 132 formed along the second major surface 78.

Mounted within each of the plated-through openings 130 are a plurality of pins 140. Pins 140 preferably comprise phosphor bronze plated with nickel and gold. Pins 140 made of various compositions are commercially available form Autosplice, Inc. of Woodside, New York and are sold under the trademark AUTOPIN/2. Pins 140 include at one end shank 142 having tabs 143 formed therealong which help to facilitate their insertion and retention within the plated-through openings 130. The other or distal ends 144 of the pins 140 are inserted into openings 145 formed in the mother board 24 of the electrical device 20. More particularly, after electrical components 25 are mounted upon mother circuit board 24, the assembled switch 18 (i.e., the cup 26, knob 27 and switching circuit board 28 and associated elements) are mounted upon mother circuit board 24 by inserting the distal ends 144 of the pins 140 into openings 145 formed in the mother circuit board 24 which correspond in location to the pins 140 of switching circuit board 28. Openings 145 are electrically connected by traces 147 to the circuits and electrical components 25 of mother circuit board 24.

Simultaneously with the insertion of pins 140 into openings 145, outwardly protruding flexible barbed ears 36 are received into corresponding slots 160 formed in mother circuit board 24. As barbed ears 36 are being inserted into slots 160, the outer edge 161 of barbed ears cam along the edges 162 of slot 160 while the barbed ears 36 flex outwardly. Insertion of the barbed ears 36 into slots 160 proceeds until the top surface 165 of mother circuit board 24 contacts the shoulders 164 of the barbed ears 36. Once the top surface 165 contacts the shoulders 164, the barbed ears 36 return to their unflexed position and the outwardly extending surface 170 of barbed ears 36 contacts the bottom surface 172 of the mother circuit board 24 thereby securely retaining the switch 18 upon the mother circuit board 24.

Pins 140 and electrical components 25 are then electrically connected to mother circuit board 24 by the wave soldering of such elements in a single operation. Since switching circuit board 28 is spaced a distance from mother circuit board 24 by pins 140, there is no risk of the switch 18 or the switching circuit 79 being damaged during the wave soldering of the mother circuit board 24. Once mother circuit board 24 has been wave soldered, it may be mounted with fasteners 180 to base 22.

Although in the preferred embodiment, outwardly protruding barbed ears 36 are utilized to attach switch 18 to mother circuit board 24, it will be appreciated that a switch made in accordance with the present invention may employ any one of a variety of means to mount such switch to the mother circuit board of an electrical device. Such alternate means may include, for example, gluing or fastening the cup 26 with fasteners to the mother circuit board of an electrical device. It will be further appreciated that in addition to mounting a switch made in accordance with the present invention to the mother circuit board of an electrical device, the present invention contemplates the mounting of such switch upon other components of the electrical device such as, for example, the cover or a secondary circuit board contained within the electrical device.

The various elements of switch 18 may be produced from any one of a variety of materials utilizing various production techniques. Preferably, however, cup 26 and knob 27 are produced from injection molded plastic. Preferably, such plastic comprises a high impact ABS plastic.

Although the invention has been shown and described with respect to a certain preferred embodiment, it is obvious that equivalent alterations and modifications will occur to others skilled in the art upon their reading and understanding of this specification. The present invention includes all such equivalent alterations and modifications, and is limited only by the scope of the following claims.

What is claimed is:

1. A multiple position rotary switch comprising an annular cup which serves as a housing for said switch and which receives a knob therein, said knob being retained within said cup by a circuit board which is removably secured to said cup, said cup including an annular race against which said knob rotates and an upstanding cylindrical sidewall, said circuit board comprising a first major surface having a circuit formed thereon and a second major surface, said circuit board being removably secured to said cup such that said first surface of said circuit board is located between said knob and said second surface of said circuit board, said race including a plurality of spaced arcuate protrusions which form multiple peaks and valleys along said race, said knob comprising a cylindrical disk having at one surface a handle and at another surface a protruding rim, said rim including a first pair of diametrically opposed upstanding platforms and a second pair of diametrically opposed upstanding platforms, said first pair of platforms being of sufficient size that upon rotation of said knob said first pair of platforms glide along the peaks of said arcuate protrusions of said race, said second pair of platforms each including a socket for receiving a spring and a ball bearing, said bearing being located on top of said spring such that said ball is sandwiched between said spring and said race, said spring providing a biasing force which retains said bearing against said race such that as said knob is rotated said bearing aligns itself in said valleys of said race thereby mechanically stabilizing said knob in preselected positions and between said preselected positions said bearing is received within said socket so as to allow said bearing to slide over said protrusions of said race, said knob including along said other surface thereof a plurality of wiping members which rotate with said nob and selectively close said circuit formed on said first surface of said circuit board as said knob is rotated to said preselected positions, said circuit board further including openings along said second surface thereof which are electrically connected to said circuit formed on said first surface thereof, said circuit board further including a plurality of upstanding pins extending from said openings of said circuit board for connecting said switch to another electrical device.

2. A multiple position rotary switch comprising an annular cup which serves as a housing for said switch and which receives for rotation therein a knob, said knob being retained within said cup by a switching circuit board, said switching circuit board being removably attached to said cup, said switching circuit board comprising a first major surface having a switching circuit formed thereon and a second major surface, said switching circuit board being removably secured to said cup by a plurality of inwardly protruding flexible barbed ears extending from said cup such that said first surface of said switching circuit board is located between said knob and said second surface of said switching circuit board, said flexible barbed ears being capable of deflecting out of position during the alignment of said switching circuit board upon said cup and also capable of returning to an unflexed position such that said barbed ears engage said switching circuit board upon proper alignment of said switching circuit board relative to said cup thereby securely retaining said switching circuit board on said cup, said switch further including detent means for mechanically stabilizing said knob in preselected positions as said knob is rotated within said cup, said knob including a plurality of wiping members which rotate with said knob and selectively close said switching circuit formed on said first side of said switching circuit board, said switching circuit board including connectors for connecting said switching circuit of said switching circuit board to another electrical device.

3. A switch as set forth in claim 2 wherein said connectors comprise a first set of plated-through openings formed in said second surface of said switching circuit board which are electrically connected to said switching circuit and a plurality of upstanding pins mounted within said first set of plated-through openings.

4. A switch as set forth in claim 3 wherein said plated-through openings of said second surface of said switching circuit board are electrically connected to said switching circuit by a second set of plated-through openings extending from said switching circuit located on said first surface of said switching circuit board through to said second surface of said switching circuit board.

5. A switch as set forth in claim 4 wherein said first set of plated-through openings are connected to said second set of plated openings by circuits formed along said second surface of said switching circuit board.

6. A switch as set forth in claim 2 wherein said detent means includes a race formed in said cup against which said knob rotates, said race including a plurality of spaced protrusions which form multiple peaks and valleys along said race, a first pair of diametrically opposed upstanding platforms and a second pair of diametrically opposed upstanding platforms formed on said knob, said first pair of platforms being of sufficient size that upon rotation of said knob said first pair of platforms glide along said peaks of said race, said second pair of platforms each including a socket for receiving a spring and a ball bearing, said bearing being located on top of said spring such that said ball bearing is sandwiched between said spring and said race, said spring providing a biasing force which retains said ball bearing against said race such that as said knob is rotated said bearing aligns itself in said valleys of said race thereby mechanically stabilizing said knob in preselected positions and between said preselected positions said bearing is received within said socket so as to allow said bearing to glide over said protrusions of said race.

7. A switch as set forth in claim 6 wherein said protrusions of said detent means comprise arcuate protrusions.

8. A switch as set forth in claim 7 wherein said wiping members comprise V-shape metal angles having slots formed therein for receiving and engaging ribs formed along various positions upon said knob.

9. A switch as set forth in claim 8 wherein said pins are spaced along the outer circumference of said switching circuit board.

10. A switch as set forth in claim 9 wherein the distal end of said pins are soldered to said another electrical device.

11. A switch as set forth in claim 10 wherein the knob includes a handle which permits a user to easily grasp the knob and rotate it.

12. A switch as set forth in claim 11 wherein said cup includes a plurality of outwardly protruding barbed ears which mount said switch upon a separate electrical device.

13. A switch as set forth in claim 11 wherein said cup includes an inwardly extending ledge against which said switching circuit board is held by said inwardly protruding flexible barbed ears.

14. An electrical device having a separate multiple position rotary switch comprising an annular cup which serves as a housing for said switch and which receives a knob therein, said knob being retained within said cup by a circuit board which is removably secured to said cup, said cup including an annular race against which said knob rotates and an upstanding cylindrical sidewall, said circuit board comprising a first major surface having a circuit formed thereon and a second major surface, said circuit board being removably secured to said cup such that said first surface of said circuit board is located between said knob and said second surface of said circuit board, said race including a plurality of spaced arcuate protrusions which form multiple peaks and valleys along said race, said knob comprising a cylindrical disk having along one surface a handle and along an opposite surface a protruding rim, said rim including a first pair of diametrically opposed upstanding platforms and a second pair of diametrically opposed upstanding platforms, said first pair of platforms being of sufficient size that upon rotation of said knob said first pair of platforms glide along the peaks of said arcuate protrusions of said race, said second pair of platforms each including a socket for receiving a spring and a ball bearing, said bearing being located on top of said spring such that said ball is sandwiched between said spring and said race, said spring providing a biasing force which retains said bearing against said race such that as said knob is rotated said bearing aligns itself in said valleys of said race thereby mechanically stabilizing said knob in preselected positions and between said preselected positions said bearing is received within said socket so as to allow said bearing to glide over said protrusions of said race, said knob including along said opposite end thereof a plurality of wiping members which rotate with said knob and selectively close said circuit formed on said first surface of said circuit board as said knob is rotated to said preselected positions, said circuit board further including openings along said second surface thereof which are electrically connected to said circuit formed on said first surface thereof, said circuit board further including a plurality of upstanding pins extending from said openings of said circuit board for electrically connecting said switch to a mother circuit board of said electrical device.

15. An electrical device as set forth in claim 14 wherein said circuit board of said switch is removably secured to said cup by a plurality of inwardly protruding flexible barbed ears extending from said cup, said flexible barbed ears being capable of deflecting out of position during the alignment of said circuit board upon said cup and also capable of returning to an unflexed position such that said barbed ears engage said circuit board upon proper placement of said circuit board upon said cup thereby securely retaining said circuit board upon said cup.

16. An electrical device as set forth in claim 15 wherein said cup includes a plurality of outwardly protruding barbed ears which attach the switch to said mother circuit board.

17. An electrical device as set forth in claim 16 wherein said wiping members of said switch comprise V-shape metal angles having slots formed therein for receiving an engaging ribs formed along various positions upon said knob.

18. A switch as set forth in claim 17 wherein said pins are spaced along the outer diameter of said circuit board.

19. An electrical device as set forth in claim 18 wherein the distal ends of said pins are connected to said mother circuit board.

20. An electrical device as set forth in claim 19 wherein the distal ends of said pins are connected to said mother circuit board by solder.

21. An electrical device having a multiple position rotary switch comprising an annular cup which serves as a housing for said switch and which receives for rotation therein a knob, said knob being retained within said cup by a switching circuit board, said switching circuit board being removably attached to said cup, said switching circuit board comprising a first major surface having a switching circuit formed thereon and a second major surface, said switching circuit board being removably secured to said cup by a plurality of inwardly protruding flexible barbed ears extending from said cup such that said first surface of said circuit board is located between said knob and said second surface of said switching circuit board, said flexible barbed ears being capable of deflecting out of position during the alignment of said switching circuit board onto said cup and also capable of returning to an unflexed position such that said barbed ears engage said switching circuit board upon proper placement of said switching circuit board upon said cup thereby securely retaining said switching circuit board on said cup, said switch including detent means for mechanically stabilizing said knob in preselected positions as said knob is rotated within said cup, said knob including a plurality of wiping members which rotate with said knob and selectively close said switching circuits formed on said first side of said circuit board, said circuit board including connectors which connects said switching circuit of said switching circuit board to a primary circuit board of said electrical device.

* * * * *